US007681851B1

(12) United States Patent
Osterholt et al.

(10) Patent No.: US 7,681,851 B1
(45) Date of Patent: Mar. 23, 2010

(54) RETRACTABLE HOOK DEVICE

(76) Inventors: Lana M. Osterholt, 261 Sycamore Grove St., Simi Valley, CA (US) 93065; Gerald R. Osterholt, 261 Sycamore Grove St., Simi Valley, CA (US) 93065

( * ) Notice: Subject to any disclaimer, the term of this patent is extended or adjusted under 35 U.S.C. 154(b) by 0 days.

(21) Appl. No.: 12/218,262

(22) Filed: Jul. 14, 2008

(51) Int. Cl.
*F16B 45/00* (2006.01)

(52) U.S. Cl. ..... 248/308

(58) Field of Classification Search ..... 248/303, 248/304, 308, 339, 691, 914
See application file for complete search history.

(56) References Cited

U.S. PATENT DOCUMENTS

| | | | | |
|---|---|---|---|---|
| 725,678 | A | 4/1903 | Cullum | |
| 2,077,629 | A | 4/1937 | Lahr | |
| 3,223,375 | A | 12/1965 | Bernasconi | |
| 3,289,985 | A * | 12/1966 | Sheiman | 248/95 |
| 3,357,670 | A | 12/1967 | Larson | |
| 3,861,633 | A | 1/1975 | Rappleye | |
| 5,425,463 | A | 6/1995 | Toscanini | |
| 5,507,423 | A | 4/1996 | Fischer | |
| 6,109,579 | A | 8/2000 | Huang | |
| 7,219,868 | B2 * | 5/2007 | Marler et al. | 248/304 |
| 7,234,672 | B1 | 6/2007 | Osterholt | |
| 7,429,024 | B2 * | 9/2008 | Boklund-Moran | 248/304 |
| 7,516,929 | B2 * | 4/2009 | Brustein et al. | 248/304 |
| 2006/0054761 | A1 | 3/2006 | Marler | |
| 2006/0289714 | A1 | 12/2006 | Boklund-Moran | |

* cited by examiner

*Primary Examiner*—Ramon O Ramirez
(74) *Attorney, Agent, or Firm*—Jack C. Munro

(57) ABSTRACT

A retractable hook device that has a hook mounted on a housing. The housing is to be securable to an exterior surface. The hook is pivotable between a retracted (stowage) position and an extended (usage) position. A release plate is mounted on the housing. The release plate can be in either an outer position or an inner position. When in the outer position the hook can be locked in either the extended position or the retracted position. When the release plate is in the inner position, the hook is pivotally movable between the extended position and the retracted position.

6 Claims, 2 Drawing Sheets

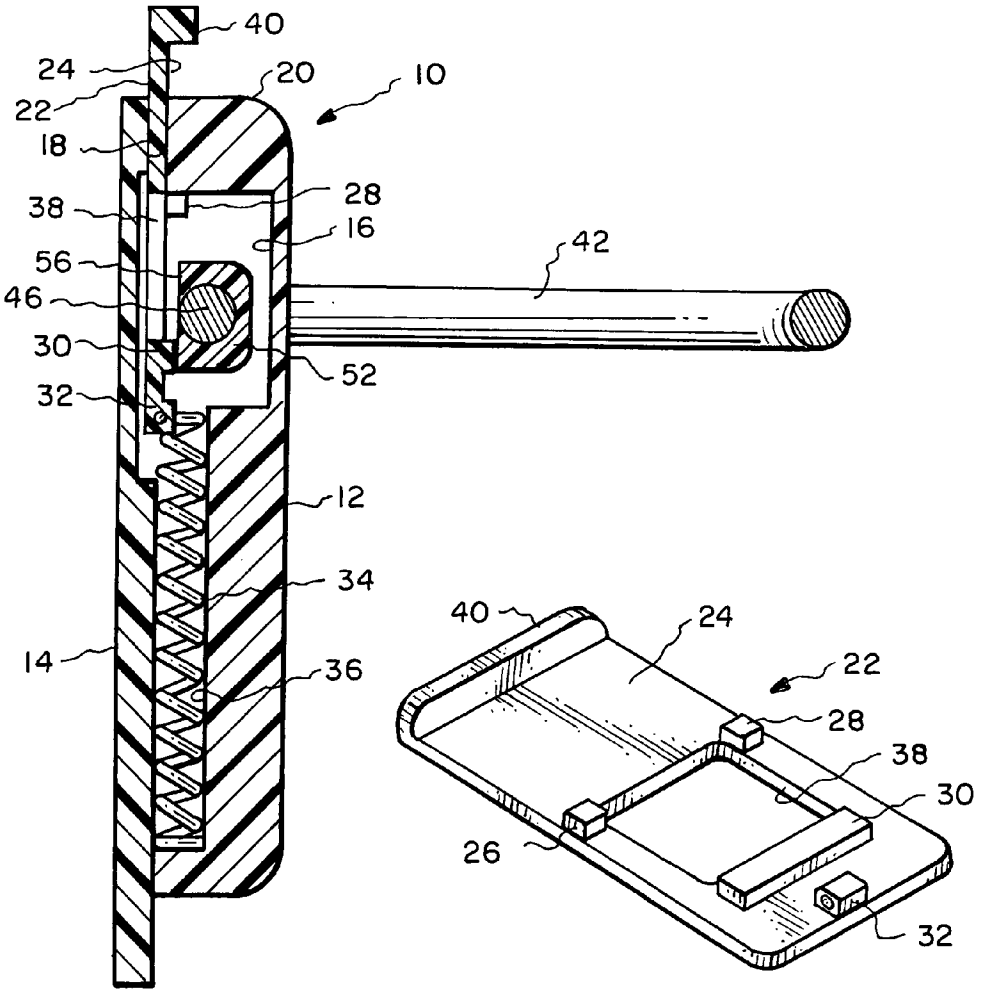
Fig. 5.
Fig. 6.
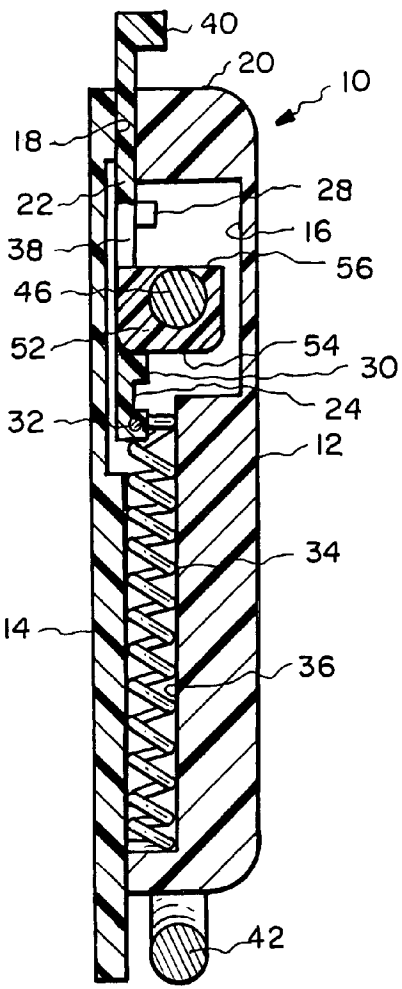
Fig. 4.

RETRACTABLE HOOK DEVICE

BACKGROUND OF THE INVENTION

1. Field of the Invention

This invention relates to a hook device that is to be mounted on an exterior surface, usually flat, such as an undersurface of a table, counter, bar top, gaming machine, shelf, cabinet or building structure wall where the hook device is to be used for suspending an item therefrom.

2. Description of the Related Art

Hook devices have long been in use for supporting personal items such as clothing, purses, umbrellas, backpacks, belts, scarves, tools, cables, towels and gadgets. The hook device comprises a U-shaped hook that protrudes outwardly from the surface on which it is mounted. When the hook device is not being used, the hook becomes a hazard capable of tearing clothes of a human or causing injury. It is desirable to have the hook retracted when not in use to eliminate this hazard and also to improve appearance avoiding the unsightly look of the not used hook. There have been designed previously numerous different types of retractable hook devices. However, these prior art devices have been complexly constructed and therefore expensive to manufacture.

It is desirable to construct a retractable hook device which is simple in construction and can optionally be installed either with adhesive or mechanical devices such as screws or nails.

It is further desirable to construct a retractable hook device which can be manufactured inexpensively and therefore sold to the consumer at an inexpensive price.

SUMMARY OF THE INVENTION

A retractable hook device that is to be attached to a vertical, inclined or horizontal surface to be used to support personal items such as by a strap extending from the personal item. The hook device includes a housing which has an internal enclosed chamber. The hook device has a hook that has an inner end and an outer end. The outer end is basically U-shaped. The inner end is straight and is located within the internal enclosed chamber. Mounted on the inner end is a protuberance. A release plate is mounted on the housing which has a main body that is located within the internal enclosed chamber and an enlarged end (actuator) that extends exteriorly of the housing. The main body has an internal opening. The enlarged end is designed to be manually contacted to cause inward sliding movement of the release plate which is to disengage the detent established by a protrusion mounted on the release plate in conjunction with the protuberance which will permit the hook to move between an extended position located transverse to the housing to a retracted position located alongside the housing. When the hook is in the retracted position and the enlarged end is released from manual contact the protrusion again abuts against the protuberance functioning as a detent to lock the hook in the retracted position.

BRIEF DESCRIPTION OF THE DRAWINGS

For a better understanding of the present invention reference is to be made to the accompanying drawings. It is to be understood that the present invention is not limited to the precise arrangement shown in the drawings.

FIG. 4 is a transverse cross-sectional view taken along line 4-4 of FIG. 3 showing the hook in the retracted position;

FIG. 5 is a transverse cross-sectional view similar to FIG. 4 showing the hook in the extended position; and FIG. 6 is an isometric view of the release plate in the direction of the upper surface of the release plate used in the retractable hook device of the present invention.

DETAILED DESCRIPTION OF THE INVENTION

Figure 1:
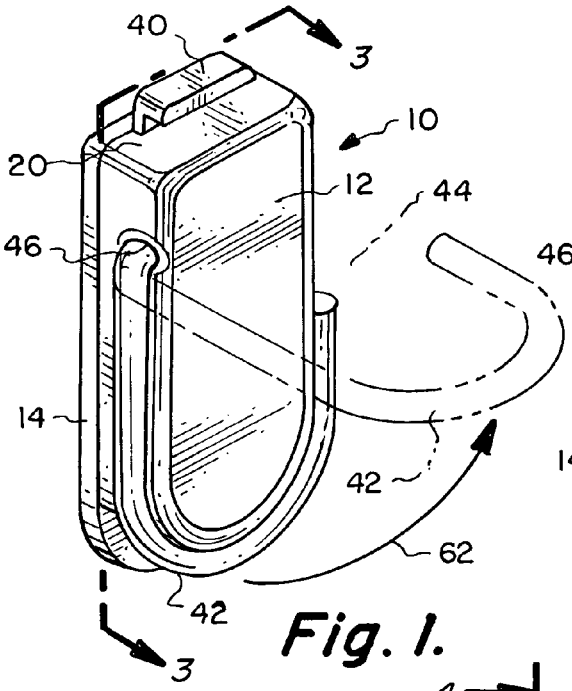
FIG. 1 is a frontal isometric view of the retractable hook device depicting movement of the hook from a retracted position to an extended position with the extended position shown in phantom lines.
Figure 2:
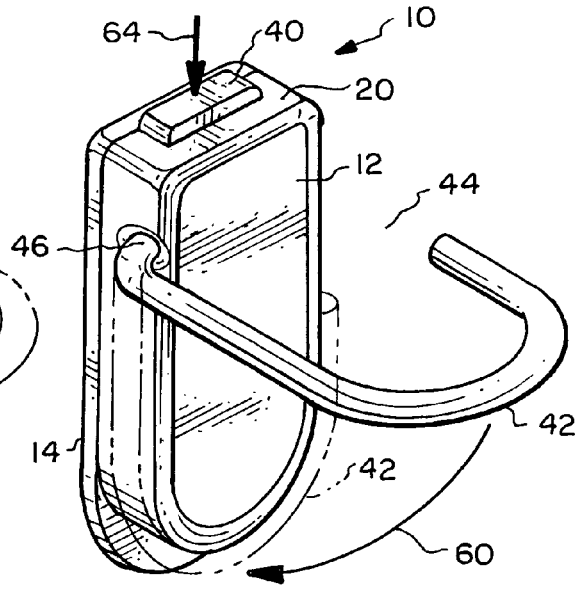
FIG. 2 is a frontal isometric view similar to FIG. 1 of the retractable hook device of the present invention depicting movement of the hook from the extended position to the retracted position with the retracted position shown in phantom lines.
Figure 3:
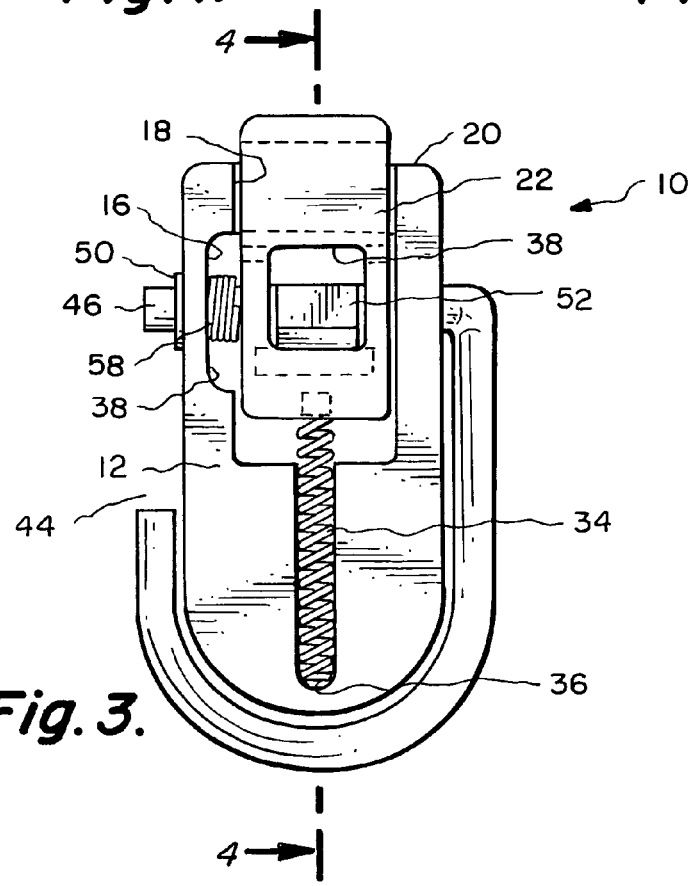
FIG. 3 is a longitudinal cross-sectional view taken along line 3-3 of FIG. 1.

Referring specifically to the drawings there is shown in FIGS. 1 to 5 the retractable hook device 10 of this invention. Hook device 10 has a metal or plastic housing 12. Housing 12 has a back surface 14. Back surface 14 is to be attached in some conventional manner to an exterior structure (not shown). Conventional manner of attachments could be by adhesive, screws or nails. Housing 12 can assume any desirable shape with generally an elongated rectangular configuration being preferred. Housing 12 is also to be as thin as possible so when the device 10 is not being used it is to be obscure.

Housing 12 has an internal enclosed chamber 16. A rectangularly shaped opening 18 is provided within the upper end 20 of housing 12. A release plate 22 is slidingly mounted within opening 18 in a close fitting relationship movable from an outer position shown in FIGS. 4 and 5 to an inner position (not shown). However, the position of the release plate 22 in FIG. 4 is different from that of FIG. 5 (moved some intermediate distance toward the inner position). Release plate 22 has an upper surface 24 on which is mounted protrusions 26, 28, 30 and 32. Protrusions 26 and 28 function as a movement limiter defining the position of the release plate 22 in the outward direction (shown in FIG. 5) where the protrusions 26 and 28 abut against the wall of enclosed chamber 16 that is located closest to upper end 20. Protrusion 32 connects with an elongated coil spring 34 with protrusion 32 functioning into continuous aligned contact between coil spring 34 and release plate 22. Coil spring 34 is mounted within cavity 36 formed within housing 12. Release plate 22 has an internal opening 38 which is rectangularly shaped. Release plate 22 has an enlarged outer end 40 which may be referred to as an actuator.

U-shaped hook 42 has an access opening 44 formed within its outer end. Hook 42 is normally constructed of metallic rod material. Hook 42 has an inner end 46 which is basically of a straight configuration where the outer end of hook 42 is curved. Inner end 46 is conducted through hole 48 formed on one side of housing 12 and through an aligned hole (not shown) formed in an opposite side of housing 12. Lock washer 50 functions to longitudinally restrain the inner end 46 relative to housing 12. The hook 42 is capable of pivotally moving relative to housing 12 between a retracted position shown in FIG. 4 and an extended position shown in FIG. 5. In the retracted position the hook 42 is located in substantial longitudinal alignment (alongside) with the housing 12. In the retracted position the hook 42 is located substantially transverse to housing 12. In this position an article or item (not shown), such as a piece of clothing, umbrella handle, strap of a purse, etc. could be inserted through access opening 44 to be supported by the hook 42.

Fixedly mounted on the inner end 46 is a protuberance 52. Protuberance 52 has a first flat surface 54 and a second flat surface 56. When the hook 42 is in the extended position (FIG. 5), the second flat surface 56 abuts against protrusion 30 which functions as a detent to lock in place the hook 42. When the user pushes on enlarged outer end 40 (indicated by arrow 64) and moves release plate 22 compressing spring 36 with this movement being sufficient to disengage second flat surface 56 from the protrusion 30, hook 42 will be automatically pivoted due to the bvias of coil spring 58 mounted on inner end 46 and connecting with housing 12 to the retracted position in direction of arrow 60. The connection between flat surface 56 and protrusion 30 is as a detent. When the hook 42 is in the retracted position, the protrusion 30 abuts against first flat surface 54 again forming a detent locking the hook 42 in position. When it is desired to again move the hook 42 to the extended position, the user just presses on enlarged outer end 40, which is now in the outer position, sufficiently to release protrusion 30 from first flat surface 54, which is now in the inner position, which will the permit the user to manually pivot the hook in the direction of arrow 62 to the extended position.

The discussion in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A retractable hook device comprising:

a housing;

a release plate is slidably mounted on said housing, a hook is connected to said housing, said hook is movable between an extended position and a retracted position, said extended position locates said hook substantially transverse to said housing, said retracted position locates said hook alongside said housing, said release plate functions to lock said hook in said extended position, manual movement of said release plate from an outer position to an inner position is to disengage said hook and permit said hook to move to said retracted position or move from said retracted position to said extended position; and a biasing means is attached to said hook which is to function to maintain said hook in said retracted position prior to being manually moved to said extended position.

2. The retractable hook device as defined in claim 1 wherein:

said housing having an internal enclosed chamber, an inner end of said hook is located within said internal chamber, said release plate has a main body which is located within said internal chamber.

3. The retractable hook device as defined in claim 1 wherein:

said hook is pivotally movable between said extended position and said retracted position.

4. The retractable hook device as defined in claim 1 wherein:

said hook has mounted thereon a protuberance, said protuberance functions as a detent when it engages with said release plate when in said extended position or said retracted position.

5. The retractable hook device as defined in claim 1 wherein:

a spring connecting with said release plate, said spring applying a continuous bias to said release plate tending to locate said release plate in said outer position.

6. The retractable hook device as defined in claim 1 wherein:

said biasing means comprising a coil spring.

* * * * *